US010337270B2

(12) United States Patent
Carisella et al.

(10) Patent No.: US 10,337,270 B2
(45) Date of Patent: Jul. 2, 2019

(54) SELECT FIRE SYSTEM AND METHOD OF USING SAME

(71) Applicant: Neo Products, LLC, Harahan, LA (US)

(72) Inventors: James V. Carisella, Metairie, LA (US); Kevin Morrill, Madisonville, LA (US)

(73) Assignee: NEO Products, LLC, Harahan, LA (US)

( * ) Notice: Subject to any disclaimer, the term of this patent is extended or adjusted under 35 U.S.C. 154(b) by 160 days.

(21) Appl. No.: 15/381,474

(22) Filed: Dec. 16, 2016

(65) Prior Publication Data

US 2017/0175472 A1 Jun. 22, 2017

Related U.S. Application Data

(60) Provisional application No. 62/268,106, filed on Dec. 16, 2015.

(51) Int. Cl.
*E21B 27/02* (2006.01)
*E21B 33/13* (2006.01)

(52) U.S. Cl.
CPC ..... *E21B 27/02* (2013.01); *E21B 33/13* (2013.01)

(58) Field of Classification Search
CPC ..... E21B 33/13; E21B 33/14; E21B 34/066; E21B 27/02
See application file for complete search history.

(56) References Cited

U.S. PATENT DOCUMENTS 2,141,179 A 12/1938 Ennis
2,526,021 A 10/1950 Fultz
2,618,345 A * 11/1952 Tucker ..... E21B 27/02 166/117

(Continued)

FOREIGN PATENT DOCUMENTS

EP 2955320 A1 12/2015

OTHER PUBLICATIONS

Hpi, et al.,Chapter 2: Tubing & Thru-Tubing Bridge Plugs, High Pressure Integrity, Inc., www.hipitools.com, 2008 Weatherford, 35 pages.

(Continued)

*Primary Examiner* — Jennifer H Gay
(74) *Attorney, Agent, or Firm* — Nolte Intellectual Property Law Group

(57) ABSTRACT

A bailer bottom, bailer system, and method for performing bailer operations at a wellsite are disclosed. The wellsite is positioned about a wellbore penetrating a subterranean formation. The bailer bottom is deployable in the wellbore. The bailer bottom includes a plurality of downhole components and a select fire unit. The plurality of downhole components includes a cement unit which includes a cement chamber and a valve. The cement chamber has a port therethrough in selective communication with the wellbore via the valve. The select fire unit includes a downhole switch electrically coupled to the plurality of downhole components. The downhole switch has a polarity for each of the plurality of downhole components. The downhole switch is triggerable to selectively move between the multiple polarities to selectively pass a signal to one of the plurality of downhole components whereby the plurality of downhole components are selectively activated.

20 Claims, 9 Drawing Sheets

(56) References Cited

U.S. PATENT DOCUMENTS 2,653,666 A 9/1953 Baker
2,695,065 A * 11/1954 Baker ..... E21B 23/065 166/117
2,707,998 A * 5/1955 Baker ..... E21B 23/065 166/117
3,064,734 A * 11/1962 Toelke ..... E21B 33/134 166/117
3,125,162 A 3/1964 Briggs, Jr. et al.
3,186,485 A 6/1965 Owen
3,199,597 A 8/1965 Kelly
3,246,708 A * 4/1966 Spickard ..... E21B 43/117 175/4.55
3,294,171 A 12/1966 Kelley
3,378,078 A 4/1968 Current
3,650,325 A 3/1972 Owens
3,768,408 A * 10/1973 Hallmark ..... E21B 43/1185 102/320
3,891,034 A 6/1975 Owen et al.
4,208,966 A * 6/1980 Hart ..... E21B 43/11857 102/310
4,696,343 A * 9/1987 Anderson ..... E21B 33/136 166/164
4,739,829 A * 4/1988 Brunner ..... E21B 27/02 166/169
4,741,396 A 5/1988 Falxa
5,033,549 A 7/1991 Champeaux et al.
5,052,489 A 10/1991 Carisella et al.
5,070,768 A 12/1991 Carisella et al.
5,115,860 A 5/1992 Charnpeaux et al.
5,115,865 A 5/1992 Carisella et al.
5,159,145 A 10/1992 Carisella et al.
5,159,146 A 10/1992 Carisella et al.
5,240,077 A 8/1993 Whitsitt
5,392,856 A * 2/1995 Broussard, Jr. ..... E21B 23/06 166/169
5,417,289 A 5/1995 Carisella
5,469,918 A * 11/1995 Haberman ..... E21B 33/134 166/291
5,469,919 A 11/1995 Carisella
5,495,892 A 3/1996 Carisella
5,531,164 A * 7/1996 Mosley ..... E21B 43/1185 102/202.12
5,564,504 A 10/1996 Carisella
5,700,969 A * 12/1997 Mosley ..... E21B 43/1185 102/202.12
5,813,459 A 9/1998 Carisella
5,975,205 A 11/1999 Carisella
6,145,598 A 11/2000 Carisella
6,158,506 A 12/2000 Carisella
6,164,375 A 12/2000 Carisella
6,202,748 B1 3/2001 Carisella et al.
6,213,217 B1 4/2001 Wilson et al.
6,223,820 B1 5/2001 Carisella
6,305,477 B1 10/2001 Carisella et al.
6,318,461 B1 11/2001 Carisella
6,341,654 B1 1/2002 Wilson et al.
6,345,669 B1 2/2002 Buyers et al.
6,354,372 B1 3/2002 Carisella et al.
6,374,917 B2 4/2002 Carisella
6,458,233 B2 10/2002 Carisella
6,543,541 B2 4/2003 Buyers et al.
6,702,009 B1 * 3/2004 Drury ..... E21B 29/02 166/212
7,000,705 B2 2/2006 Buyers et al.
7,614,454 B2 11/2009 Buyers et al.
7,703,511 B2 4/2010 Buyers et al.
7,779,905 B2 8/2010 Carisella et al.
8,025,105 B2 9/2011 Templeton et al.
8,113,282 B2 2/2012 Picou
8,191,645 B2 6/2012 Carisella et al.
8,534,367 B2 9/2013 Carisella
8,757,278 B2 * 6/2014 Smithson ..... E21B 23/00 166/381
8,813,841 B2 8/2014 Carisella
9,080,405 B2 7/2015 Carisella
9,476,272 B2 10/2016 Carisella
1,476,747 A1 12/2016 Wolever
2004/0020709 A1 * 2/2004 Wilson ..... E21B 23/00 181/103
2004/0084190 A1 5/2004 Hill et al.
2004/0108114 A1 * 6/2004 Lerche ..... E21B 17/003 166/302
2006/0102336 A1 * 5/2006 Campbell ..... E21B 27/02 166/65.1
2007/0012435 A1 1/2007 Obrejanu
2008/0196896 A1 * 8/2008 Bustos ..... E21B 43/26 166/281
2009/0095466 A1 4/2009 Obrejanu
2010/0059233 A1 * 3/2010 Smithson ..... E21B 23/00 166/385
2010/0122814 A1 5/2010 Picou
2010/0155054 A1 6/2010 Innes et al.
2010/0186949 A1 7/2010 Xu
2011/0067854 A1 * 3/2011 Love ..... E21B 17/06 166/55.1
2012/0006217 A1 * 1/2012 Anderson ..... E21B 43/1185 102/215
2012/0160483 A1 * 6/2012 Carisella ..... E21B 27/02 166/270
2012/0247755 A1 10/2012 Colon et al.
2012/0250208 A1 * 10/2012 Love ..... E21B 43/1185 361/166
2012/0255842 A1 * 10/2012 Runkel ..... E21B 43/1185 200/238
2013/0327544 A1 * 12/2013 Carisella ..... E21B 23/04 166/381
2014/0326465 A1 11/2014 Carisella
2016/0040509 A1 * 2/2016 Castillo ..... E21B 17/003 166/244.1
2017/0175471 A1 * 6/2017 Boleyn, Jr. ..... E21B 27/02
2017/0175472 A1 * 6/2017 Carisella ..... E21B 27/02
2018/0051534 A1 * 2/2018 El Mallawany ..... E21B 34/066

OTHER PUBLICATIONS

Hpi, et al.,Chapter 3: Bailer Systems, High Pressure Integrity, Inc., www.hpitools.com, 2008 Weatherford, 44 pages.

Thru-Tubing Systems, et al.,Wireline Products Catalog, Revised Feb. 12, 2014, 44 pages.

"Schlumberger Oilfield Glossary entry for dump bailer", Accessed Jul. 23, 2013 via www.glossary.oilfield.slb.com.

PCT Notification of Transmittal of International Search Report and the Written Opinion of the International Searching Authority dated Feb. 13, 2019, issued from the International Searching Authority in related PCT Application No. PCT/US2018/057388, (14 pages).

* cited by examiner

SELECT FIRE SYSTEM AND METHOD OF USING SAME

CROSS-REFERENCE TO RELATED APPLICATION

The application claims the benefit of U.S. Provisional Application No. 62/268,106, filed on Dec. 16, 2015, the entire contents of which are hereby incorporated by reference herein.

BACKGROUND

This present disclosure relates generally to wellsite equipment and methods. More specifically, the present disclosure relates to setting and/or bailer bottoms and associated devices used in performing wellsite operations.

Wellsite equipment may be used to investigate and access subsurface formation for the purpose of producing hydrocarbons. Such equipment may include drilling tools advanced into the formation to form a wellbore, completion tools to prepare the wellbore for production, and production tools to produce fluid from subsurface reservoirs to surface equipment.

Other equipment, such as wireline tools and slickline tools may be deployed into the wellbore to perform various processes, such as performing a workover operation to isolate portions of the wellbore. The wireline/slickline tools may include components, such as a setting tool to perform a plugback operation to set a bridge plug and a bailer bottom to dump cement into the plugged portion of the wellbore. Examples of such tools and components are provided in U.S. Pat. Nos. 5,392,856, 8,813,841, an US2014/0326465, the entire contents of which are hereby incorporated by reference herein.

Despite the advances in wireline/slickline tools, there remains a need to develop techniques to efficiently perform workover and other wellsite operations.

SUMMARY

In at least one aspect, the present disclosure relates to a bailer bottom for performing bailer operations at a wellsite. The wellsite is positioned about a wellbore penetrating a subterranean formation. The bailer bottom is deployable in the wellbore. The bailer bottom comprises a plurality of downhole components and a select fire unit. The downhole components comprise a cement unit. The cement unit comprises a cement chamber and a valve. The cement chamber has a port therethrough in selective communication with the wellbore via the valve. The select fire unit comprises a downhole switch electrically coupled to the downhole components. The downhole switch has a polarity for each of the downhole components. The downhole switch is triggerable to selectively move between the multiple polarities and selectively pass a signal to one of the downhole components whereby the downhole components are selectively activated.

The cement unit may also comprise a piston slidably positionable in the cement chamber between an extended position and a retracted position, with a volume of the cement chamber reduced as the piston moves from the retracted to the extended position. The cement unit may also comprise at least one spring positioned about the piston, the spring biased to urge the piston to the extended position. The piston may be electrically coupled between a surface trigger and the valve.

The cement unit may also comprise an electrical contact rod electrically coupled between the piston and the valve. An end of the electrical contact rod extends into a cavity in the piston for slidable movement therebetween. The cement unit may also comprise a threaded connector at an end thereof having an inlet to mechanically receive, and an electrical connector to electrically connect with, another of the downhole components. The bailer bottom may also comprise a windowed sleeve connectable between the threaded connector and the cement unit.

The valve may comprise a solenoid movable between an open and a closed position. The downhole switch may comprise a diode package.

The select fire unit may comprise a crossover stab-in connection connectable to the cement unit, a stab-in bottom sub, and a stab-in tandem sub between the crossover stab-in connection and the stab-in bottom sub. The select fire unit may also comprise feed-throughs. Each of the feed-throughs is positioned in the crossover stab-in connection, the stab-in bottom sub, and/or the stab-in tandem sub. Each of the feed-throughs may be electrically coupled between the downhole switch and one of the valve, a surface trigger, and at least one of the downhole components.

The downhole switch may comprise electrical connectors. Each of the multiple polarities electrically is coupled to the downhole components via the electrical connectors. The downhole components may comprise plugs, packers, valves, injectors, perforating guns, hangers, cement plug dripping heads, setting tools, bailing tools, sampling tools, testing tools, measuring tools, communication tools, a bailer window sub, and/or bailer joints.

In another aspect, the present disclosure relates to a bailer system for performing bailer operations at a wellsite. The wellsite is positioned about a wellbore penetrating a subterranean formation. The bailer system comprises a bailer bottom comprising a plurality of downhole components and a select fire unit. The downhole components comprise a cement unit. The cement unit comprises a cement chamber and a valve. The cement chamber has a port therethrough in selective communication with the wellbore via the valve. The select fire unit comprises a downhole switch electrically coupled to the downhole components. The downhole switch has a polarity for each of the downhole components. The downhole switch is triggerable to selectively move between the multiple polarities and selectively pass a signal to one of the downhole components whereby the downhole components are selectively activated. The bailer system also comprises at least one trigger electrically coupled to the downhole switch to send the signal thereto, whereby the downhole components are selectively activated.

The trigger may comprise a surface trigger and/or a downhole trigger. The trigger may comprise a digital switch control box. The digital switch control box may comprise a power switch and at least one digital switch. Each of the one digital switches corresponds to one of the cement unit and another of the downhole components.

The bailer bottom may be deployed into the wellbore by a cable. The bailer system may also comprise a pump in fixture connectable to the valve.

Finally, in another aspect, the present disclosure relates to a method of for performing bailer operations at a wellsite. The wellsite is positioned about a wellbore penetrating a subterranean formation. The method involves deploying a bailer bottom into the wellbore. The bailer bottom comprises a plurality of downhole components and a select fire unit. The downhole components comprises a cement unit. The cement unit comprises a cement chamber and a valve. The cement chamber has a port therethrough in selective communication with the wellbore via the valve. The select fire unit comprises a downhole switch electrically coupled to the downhole components. The downhole switch has a polarity for each of the downhole components. The method also involves triggering the downhole switch to selectively move between the polarities. The method continues with selectively activating the downhole components by passing an activation signal to the downhole components corresponding to the triggered polarity.

The triggering may involve sending the signal from a surface location to the downhole switch. The triggering may also involve receiving the signal at the downhole switch and moving to one of the polarities based on the signal.

The selectively activating may involve passing the activation signal from the downhole switch to at least one of the downhole components corresponding to the triggered polarity. The selectively activating may involve sequentially and/or simultaneously activating.

The method may also involve withdrawing the bailer bottom from the wellbore and replacing one or more of the downhole components.

BRIEF DESCRIPTION OF THE DRAWINGS

So that the above recited features and advantages can be understood in detail, a more particular description, briefly summarized above, may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

The present disclosure relates to a select fire bailer system including a trigger and a downhole auxiliary tool comprising a bailer bottom and a select fire unit. The select fire unit may be used to selectively direct electrical power to one or more components in the auxiliary tool to selectively activate one or more such components to perform wellbore operations. The trigger is coupled to the select fire unit for selectively firing (activating or actuating) components of the auxiliary tool, such as the bailer bottom, a setting tool, and/or other components of the downhole auxiliary tool.

"Auxiliary tool" as used herein refers to downhole tools introduced or carried into a subterranean oil or gas well on a conduit, such as wire line, electric line, continuous coiled tubing, threaded work string, or the like. These auxiliary tools may include various components, such as expandable elastomeric, permanent or retrievable plugs, packers, ball-type and other valves, injectors, perforating guns, tubing and casing hangers, cement plug dropping heads, downhole tools (e.g., setting, bailing, sampling, testing, measuring, communicating, etc.), and/or other devices that may be encountered during the drilling, completion, or remediation of a subterranean well.

The auxiliary tool may be modular to allow for the connection of one or more of the components thereto. The trigger may be coupled to such components by a trigger link to selectively activate one or more such components of the auxiliary tool to perform one or more downhole operations, such as setting, dumping, measuring, sampling, communicating, etc. Such downhole operations may be triggered to perform the operations sequentially, simultaneously, and/or as needed. Multiple devices may be triggered during a single downhole run, thereby eliminating removal of the tool, reducing downtime, and/or increasing efficiency of the bailer system.

Figure 1:
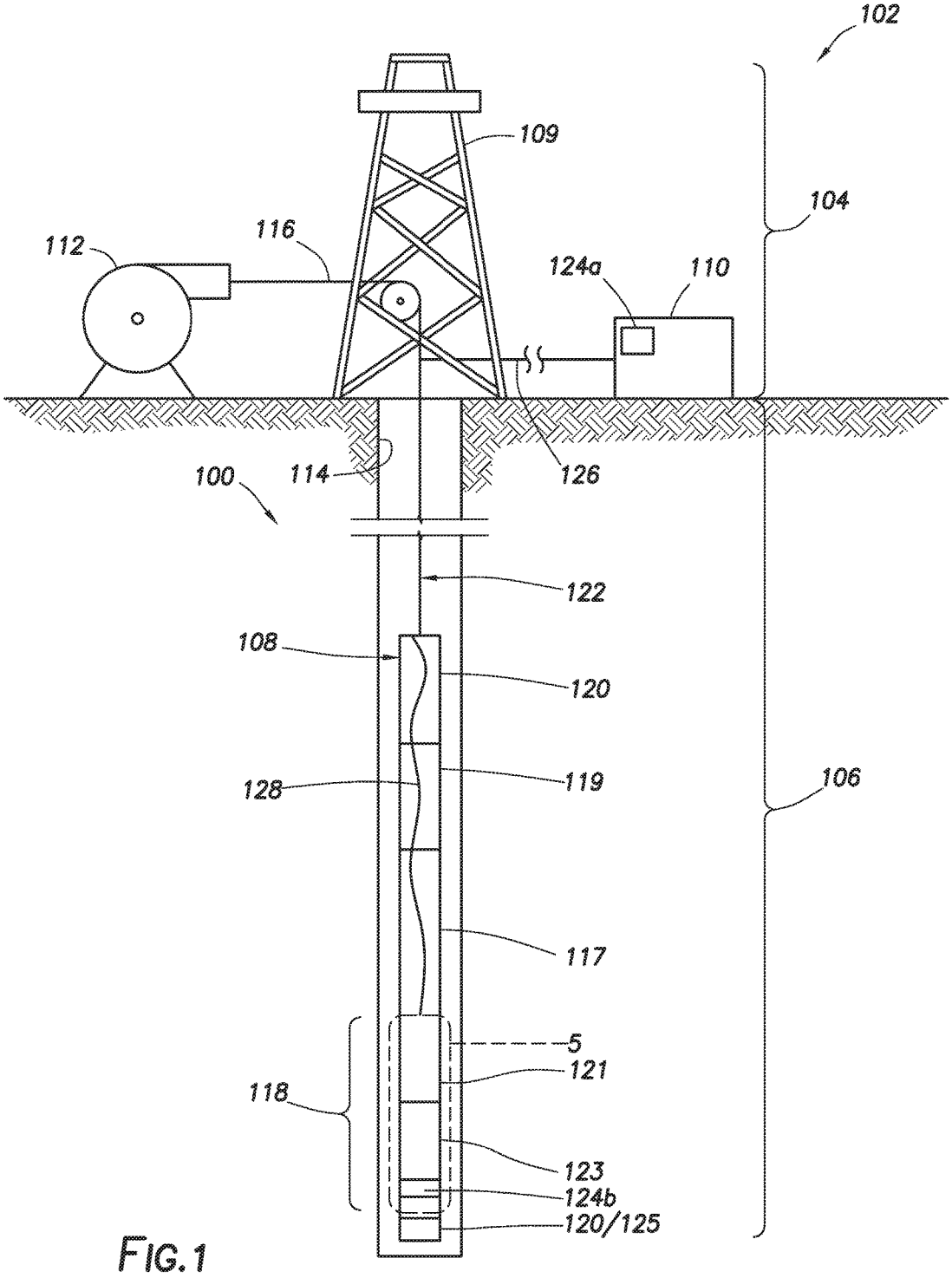
FIG. 1 is a schematic diagram, partially in cross-section of a wellsite having a select fire bailer system comprising an auxiliary tool with a select fire bailer bottom.

FIG. 1 depicts an example environment in which a bailer system 100 may be employed. In this example, the bailer system 100 is used at a wellsite 102 having surface equipment 104 and subsurface downhole equipment 106. The surface equipment 104 includes a rig 109, a surface unit 110 and a wireline unit 112 with a wireline 116. The surface unit 110 may be provided with a processing unit, databases, controllers, interface, and/or other electronics for operation with the surface and/or downhole equipment 104, 106 (e.g., an auxiliary tool 108). The wireline 116 may be a communication cable capable of passing power, data, and/or communication signals between the auxiliary tool 108 and the surface unit 110.

The downhole equipment 106 includes the auxiliary tool 108 deployed from the rig 109 into a wellbore 114 by the wireline 116. The wireline 116 is supported by the wireline unit 112 and is coupled to the surface unit 110 for communication therewith. The auxiliary tool 108 is depicted as a wireline tool deployed by the wireline 116, but other tools, such as a slickline or other downhole tool may also be employed as (or with) the auxiliary tool 108.

Various components may optionally be provided in the auxiliary tool 108. The auxiliary tool 108 may be a modular tool capable of assembling in various configurations of the components for performing desired operations. The auxiliary tool 108 may be deployed with a select combination of the components. The auxiliary tool 108 may be withdrawn from the wellbore 114, reconfigured and/or maintained, and redeployed for additional operations.

As shown in the example of FIG. 1, the auxiliary tool 108 includes a series of components connected together for performing various downhole operations. The components as shown include a bailer bottom 118, bailer joints 117, a bailer window sub 119, and wireline subs 120. As schematically indicated by the wireline subs 120, additional wireline components may be attached to the auxiliary tool 108 (e.g., at an uphole and/or downhole end thereof). The bailer window sub 119 is connected near an uphole end of the auxiliary tool 108, and may include a window for viewing cement in the auxiliary tool 108. The bailer joints 117 are connected to the wireline sub 120 for receiving and storing cement therein.

The bailer bottom 118 is located at a downhole end of the auxiliary tool 108, and connected downhole of the bailer joints 117 for performing bailer bottom 118 and/or setting operations. The bailer bottom 118 includes a cement unit 121 and a select fire unit 123. The cement unit 121 may be positioned along the auxiliary tool 108 to receive and distribute cement. Examples of cement devices that may be used are provided in U.S. Pat. Nos. 5,392,856, 8,813,841, and US2014/0326465 previously incorporated by reference herein. The cement unit 121 can include, for example, cement mixtures disposable downhole to form a cement along the wellbore 114. Such cement mixtures can include one or more of bridging material (e.g., gravel, sand, aggregate, etc.), water, and/or other materials disposable in cement.

Figure 2A:
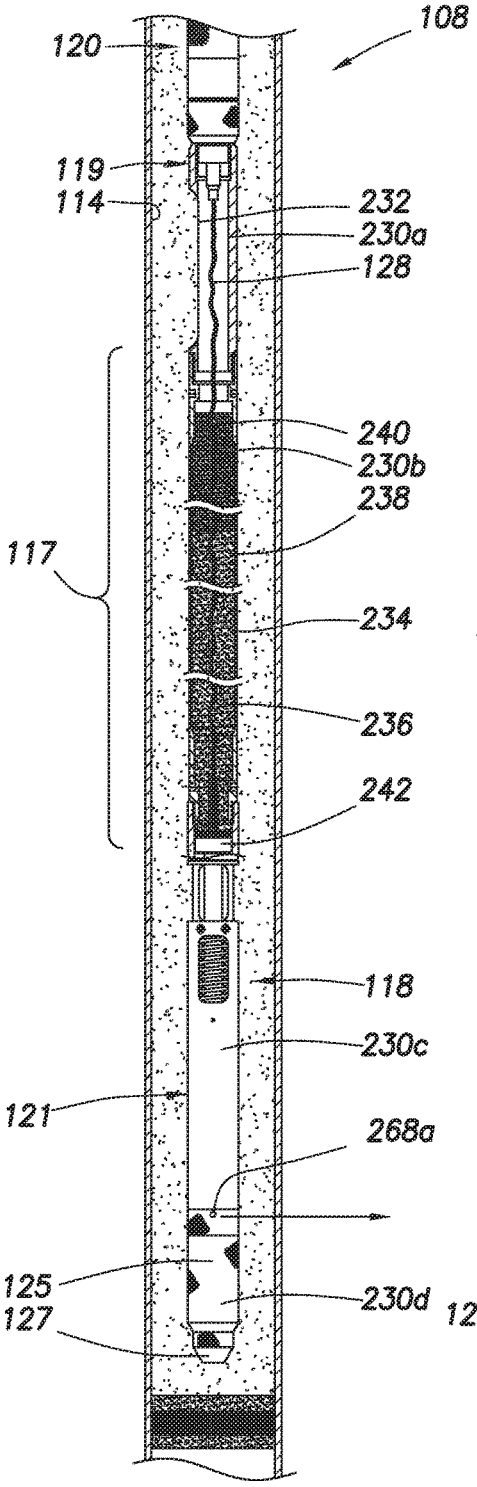
FIGS. 2A and 2B are cross-sectional views of portions of the auxiliary tool and the select fire bailer bottom of FIG. 1, respectively.
Figure 2B:
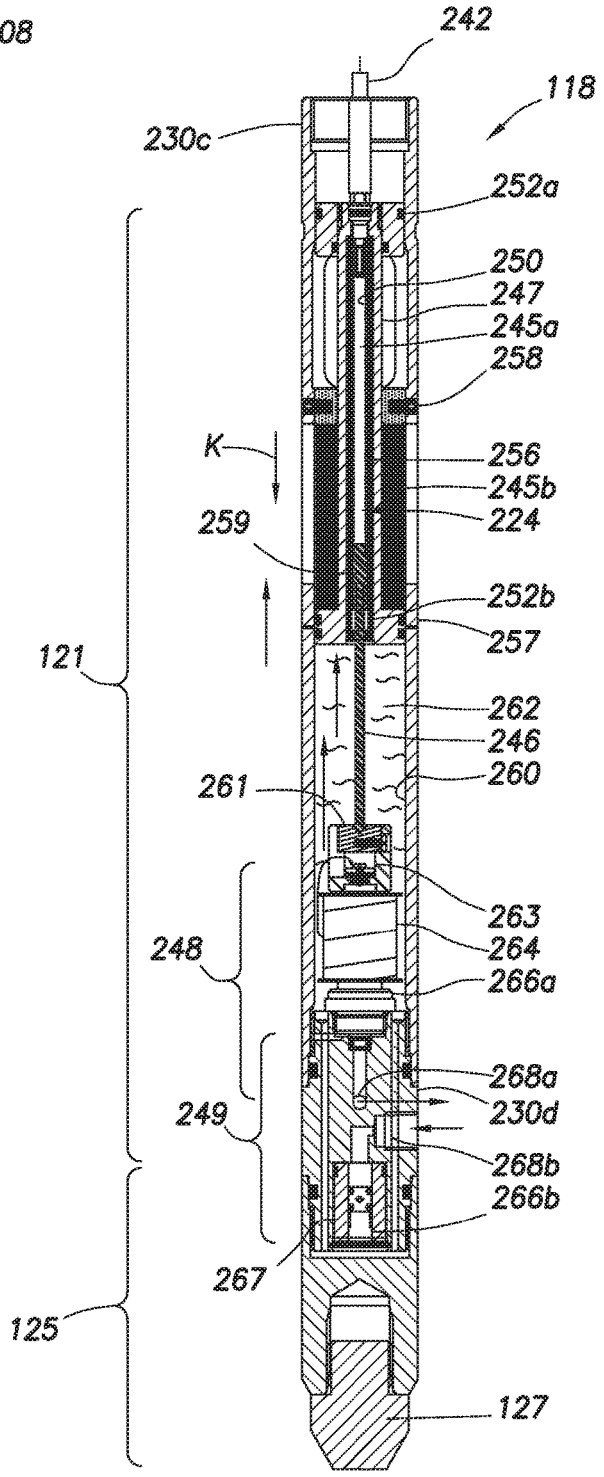

The select fire unit 123 may be a modular trigger component coupled to the cement unit 121. The select fire unit 123 may optionally be replaced with a setting tool for setting a cement plug in the wellbore as shown in FIGS. 2A and 2B. The select fire unit 123 may be used to selectively actuate the cement unit 121 to distribute cement from the bailer bottom 118. The select fire unit 123 is triggered by a trigger system 122 extending from the surface unit 110 to the select fire unit 123.

The trigger system 122 includes an uphole trigger 124*a*, a communication link 126, a communication cable 128, and a downhole switch (e.g., diode) 124*b*. The uphole trigger 124*a* may be positioned at the surface unit 110 (or other location) to allow activation, for example, by an operator. The uphole trigger 124*a* may be coupled via the wireline 116 to the auxiliary tool 108. The uphole trigger 124*a* may include switches used to activate components of the auxiliary (downhole tool) as is described further herein.

The communication cable 128 extends from the wireline 116 through the auxiliary tool 108 and to the downhole switch 124*b*. The downhole switch 124*b* may be positioned in or coupled to the select fire unit 123. The communication cable 128 may be operatively coupled to the select fire unit 123 and/or one or more components of the auxiliary tool 108 for communication with the surface trigger 124*a*. One or more downhole switches 124*b* may be provided about the auxiliary tool 108 to selectively activate one or more of the components (sequentially or simultaneously). The downhole switch(es) 124*b* may have multiple polarities which may be configured to selectively activate one or more of the components of the auxiliary tool 108 as is described further herein.

The trigger and/or switches may be used to enable activation of one or more components of the auxiliary (downhole) tool to perform one or more downhole operations. For example, operations, such as setting a plug in tubing or casing followed by cement slurry placement atop the plug, may be performed in a dual-run operation. In another example, the bailer bottom 118 may be provided with a plug setting tool 125 to allow setting and cement slurry placement in a single run. Signals may be sent to a variety of components for activation of components of the auxiliary tool, such as setting tools, bailer bottoms, stroker tools, perforating guns, gamma guns, cutting tools, etc. Other example multiple operations may involve one or more of: open a sliding sleeve door (SSD) with a stroker tool, locating the bailer bottom adjacent the open SSD, and actuating the bailer bottom to pump into the well therein squeezing the contents of the bailer system into the open SSD; building a composite aggregate platform atop a thru-tubing bridge plug with a minimum number of bailer bottom runs providing a maximum pressure ($\Delta P$) capability (capable of supporting thousands of feet (meters) of kill weight (wgt.) fluid, 16 pounds per gallon (ppg) (1917 kg/m$^3$) cement slurry, etc.); building composite cement slurry plugs with exceptionally high channeling resistance in perforated casing intervals (ideal for water shut-off projects); and/or perforating a casing interval and locating the bailer bottom in the perforated interval, actuating the bailer bottom while pump into the well therein, and squeezing the contents of the bailer system into the perforations. These and other operations may be performed.

FIGS. 2A and 2B are cross-sectional views depicting portions of the auxiliary tool 108 and the bailer bottom 118, respectively, of FIG. 1 in greater detail. The bailer window sub 119 includes a housing 230*a* to receive fluids, and an open window 232 through the housing 230*a*. The bailer sub 119 is connected at its uphole end to the wireline sub 120. The bailer sub 119 is connected at its downhole end to an uphole end of the bailer joints 117 (FIG. 1).

One or more bailer joints 117 are connectable in series and include a housing 230*b* defining a cavity 234 to receive fluids therein. In the example shown, slurry 236, cement 238 and water 240 are disposed in layers within the bailer joints 117. A downhole end of the bailer joints 117 is connected by a connector 242 to the cement unit 121 of the bailer bottom 118. The cement unit 121 is communicatively coupled by the wireline 116 (FIG. 1) and connector 242 to selectively dump cement out of outlet port 268*a*.

As shown in this example, the select-fire unit 123 (FIG. 1) of the bailer bottom 118 has been removed and replaced with the plug setting tool 125 with a cement plug 127 (e.g., base end cap plug) at a base (or downhole) end of the auxiliary tool 108. The setting tool 125 may be an explosive or non-explosive setting tool employable by the bailer bottom 118 to install the cement plug 127 in the wellbore 114. Examples of setting tools that may be used as the setting unit are provided in U.S. Pat. Nos. 5,392,856, 8,813,841, an US2014/0326465, previously incorporated by reference herein, as well as U.S. Pat. No. 8,534,367, US2013/0327544, the entire contents of which are hereby incorporated by reference herein.

As shown in FIG. 2B, the cement unit 121 of the bailer bottom 118 may include a housing 230*c*, the connector 242, a piston 224, an electric contact rod 246, and a solenoid assembly 248. The housing 230*c* may be a unitary device with all components therein, or modular with separate subs defined for housing separate components of the bailer bottom 118. The connector 242 extends into an upper end of the housing 230*c* (or a neo pig tail sub attached to the housing 230*c*).

The piston 224 is slidably positioned in the housing 230*c*. An inner spring 245*a* (e.g., an electric contact spring) and an outer spring 245*b* (e.g., compression (or coil) spring) is provided inside and outside of the piston 224, respectively. An insulation sleeve 247 (e.g., made of stainless steel) may be positioned between the inner spring 245*a* and the piston 224 to provide insulation. The insulation sleeve 247 may include a spring contact insulator and an insulating spacer bushing.

Figure 3A:
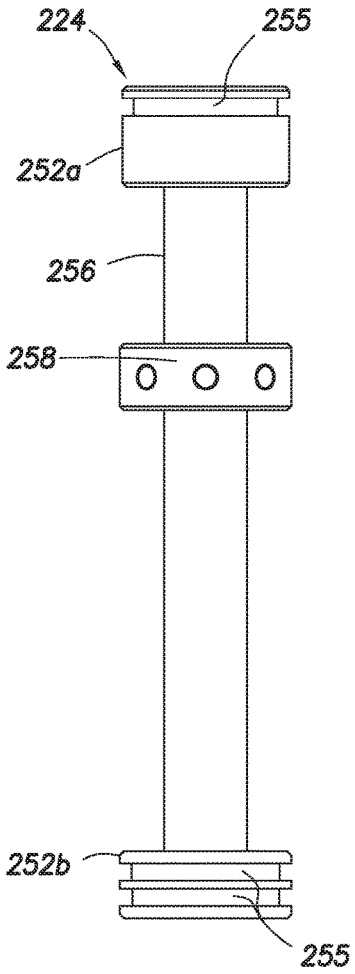
FIGS. 3A and 3B are detailed views of a piston and spring usable in the bailer bottom.
Figure 3B:
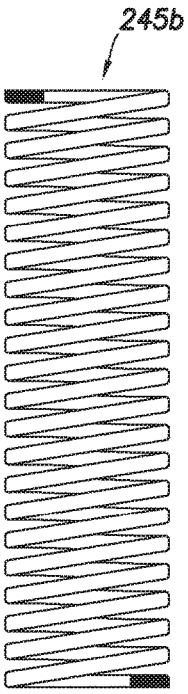

Referring to FIGS. 2B, 3A and 3B, the piston 224 has an upper piston head 252*a* and a lower piston head 252*b* with a piston shaft 256 therebetween to receive the outer spring 245*b* thereon. The upper and lower piston heads 252*a,b* are slidably positionable in the housing 230*c*. Seals (e.g., O-rings, gaskets, etc.) may be provided about grooves 255 in the upper and lower piston heads 252*a,b*. The piston may also have a guide bearing (or bushing) 258 about the piston shaft 256. The guide bearing 258 may be positioned in the housing 230*c* with a hole to receive the piston 224 therethrough. The lower piston head 252*b* is axially movable along the housing 230*c* to selectively engage weep holes 257 through the housing 230*c*.

Referring back to FIG. 2B, a chamber 260 is defined in the housing 230*c* between the lower piston head 252*b* and the solenoid assembly 248 to receive fluid 262 therein. Fluid communication may selectively be provided between the chamber 260 and the wellbore 114 external to the housing 230*c* via the weep holes 257 by slidably positioning the lower piston head 252*b* to selectively block and/or open the weep holes 257.

The piston 224 has a cavity 250 therein for receiving an uphole end of the contact rod 246. The contact rod 246 has a rod end 259 about the uphole end slidably movable in the cavity 250 of the piston 224. The contact rod 246 extends through the chamber 260 between the piston 224 and the solenoid assembly 248 to provide an electrical connection therebetween. The contact rod 246 has a sliding spring electrical contact sub-assembly at the uphole/rod end 259 positionable in the cavity 250, and extends through chamber 260 and into a brass V-notch receptacle 261 housed in a PEEK (polyetheretherketone) insulating cap 263 of the solenoid assembly 248. The contact rod 246 may provide an electrical connection to the connector 242, and may have cables passing therethrough to electrically connect the connector 242 to the solenoid assembly 248. Cables from the contact rod 246 may be coupled to the solenoid assembly 248 for electrical communication therebetween.

The solenoid assembly 248 includes the insulating cap (connector) 263 and a solenoid 264. The solenoid assembly 248 may be used to convert electrical energy to linear motion to selectively move the exit valve 266*a* between an open and a closed position. The solenoid assembly 248 may be in the housing 230*c* and connected to a dual tandem sub 249. The dual tandem sub 249 includes a housing 230*d*, an exit valve 266*a*, and an inlet valve 266*b*. The housing 230*d* may have exit port 268*a* and inlet port 268*b* forming holes therethrough, and a passage 267 extending through the housing 230*d* to establish fluid communication from chamber 260 to inlet valve 266*b*. The exit valve 266*a* is fluidly connected to an exit port 268*a* extending through the housing 230*d* to selectively release cement from the bailer joints 117 and into the wellbore 114.

The inlet port 268*b* (with an optional inlet valve 266*b*) may also be provided through the housing 230*d* to receive fluid 262 therein. Fluid 262 may be input into the inlet port 268*b* as indicated by the inbound arrow, pass through check valve 266*b*, and into chamber 260 to drive the piston 224 upward as indicated by the arrows to compress the outer spring 245*b* and activate the solenoid assembly 248 via the connector 242. The inlet valve 266*b* may be provided with a filter screen and low head socket cap.

As fluid 262 enters the chamber 260, pressure increases and applies a force to the lower piston head 252*b*. The outer spring 245*b* is positioned between the guide bearing 258 and the lower piston head 252*b* and is compressible therebetween as force is applied to the piston 224. The outer spring 245*b* has a spring force K such that the piston 224 is urged to a downhole position until sufficient pressure is built up to compress the outer spring 245*b*. Once activated, the solenoid 264 may open the exit port 268*a* and release the cement as indicated by the outbound arrow.

The cement unit 121 may also be provided with other features, such as a retaining sleeve and a fixed spring pedestal between connector 242 and the piston 224, and various devices, such as O-rings, set screw, and retaining rings.

Figure 4:
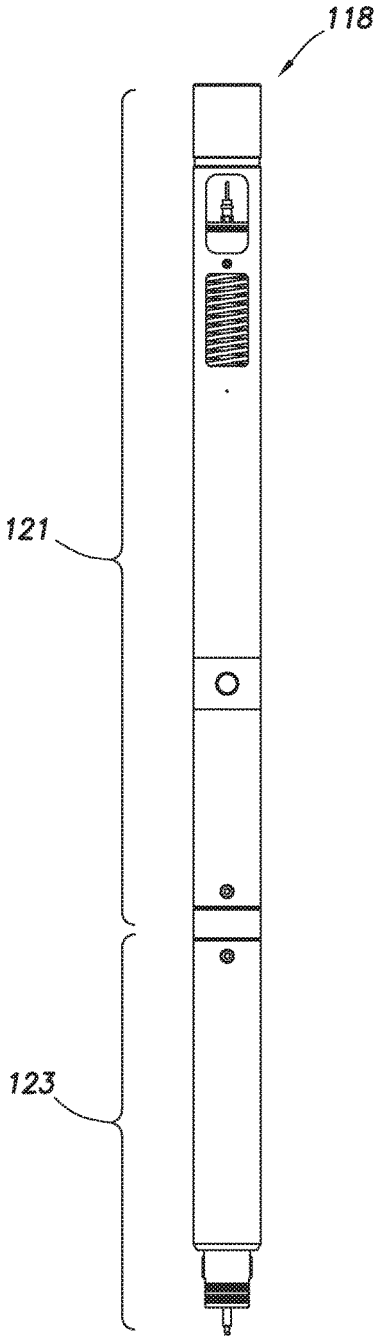
FIG. 4 is a side view of the bailer bottom of FIG. 1.
Figure 5A:
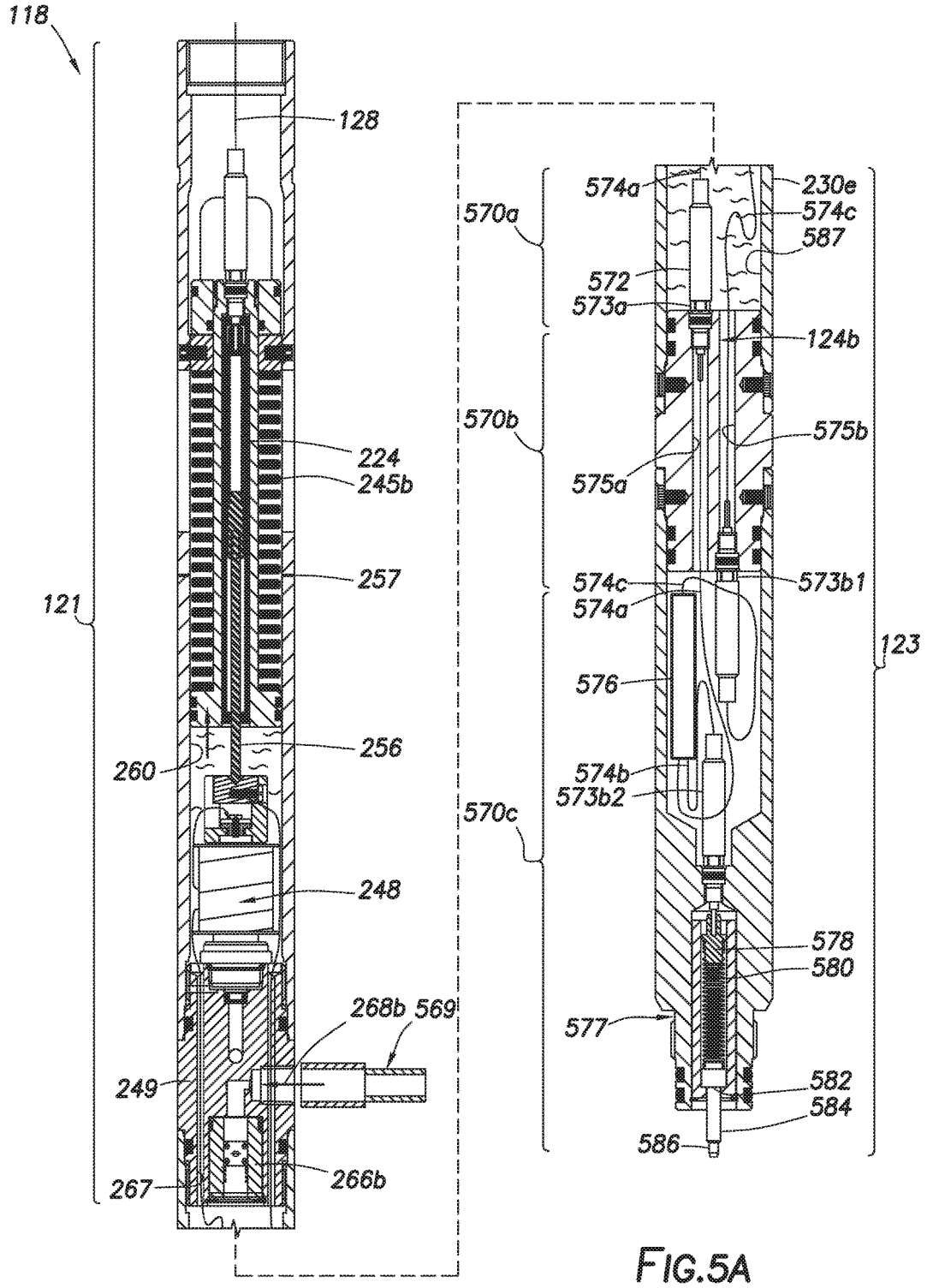
FIGS. 5A and 5B are longitudinal cross-sectional views of a portion 5 of the auxiliary tool of FIG. 1 depicting the self-fire bailer bottom in a pre-cocked and a cocked position, respectively.
Figure 5B:
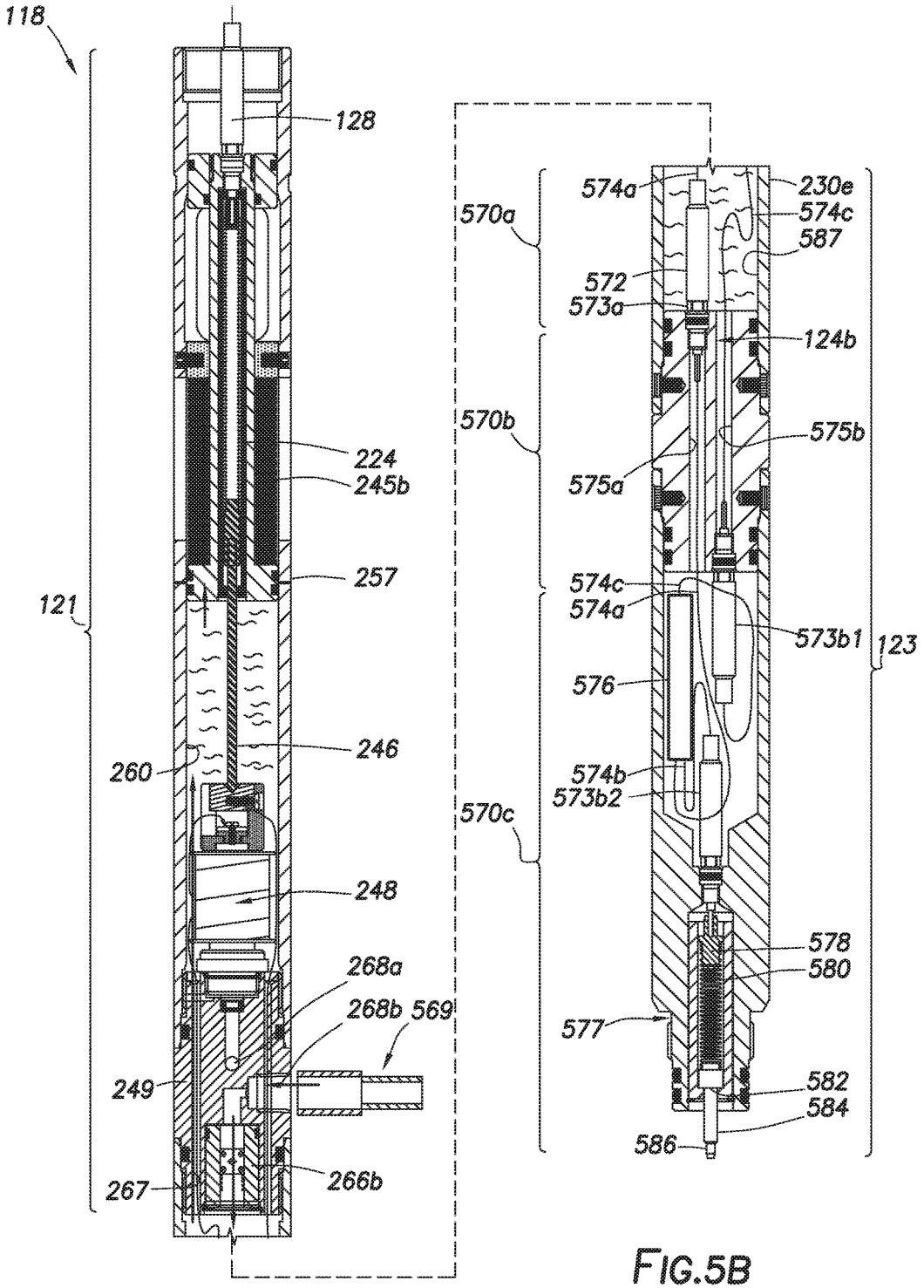

FIGS. 4 and 5A and 5B show various views of the bailer bottom 118 of the auxiliary tool 108 of FIG. 1. FIG. 4 shows a perspective view of the bailer bottom 118. FIGS. 5A and 5B show longitudinal, cross-sectional views of the auxiliary tool in a pre-cocked and a cocked position, respectively. As shown in these views, the bailer bottom 118 includes the cement unit 121 at an uphole end and the select fire unit 123 at a downhole end thereof. As schematically shown in FIG. 5A, the bailer bottom 118 may also be provided with a pump in fixture 569. Other optional devices usable with the bailer bottom include a pipe plug, a new weep hole clean out wire, and a retaining sleeve for rubber boot.

The cement unit 121 may be similar to the cement unit 121 of FIGS. 2A and 2B. The cement unit 121 (and other components connected to the auxiliary tool 108) may be provided with a threaded release connection 219 as shown in FIGS. 6A and 6B.

Figure 6A:
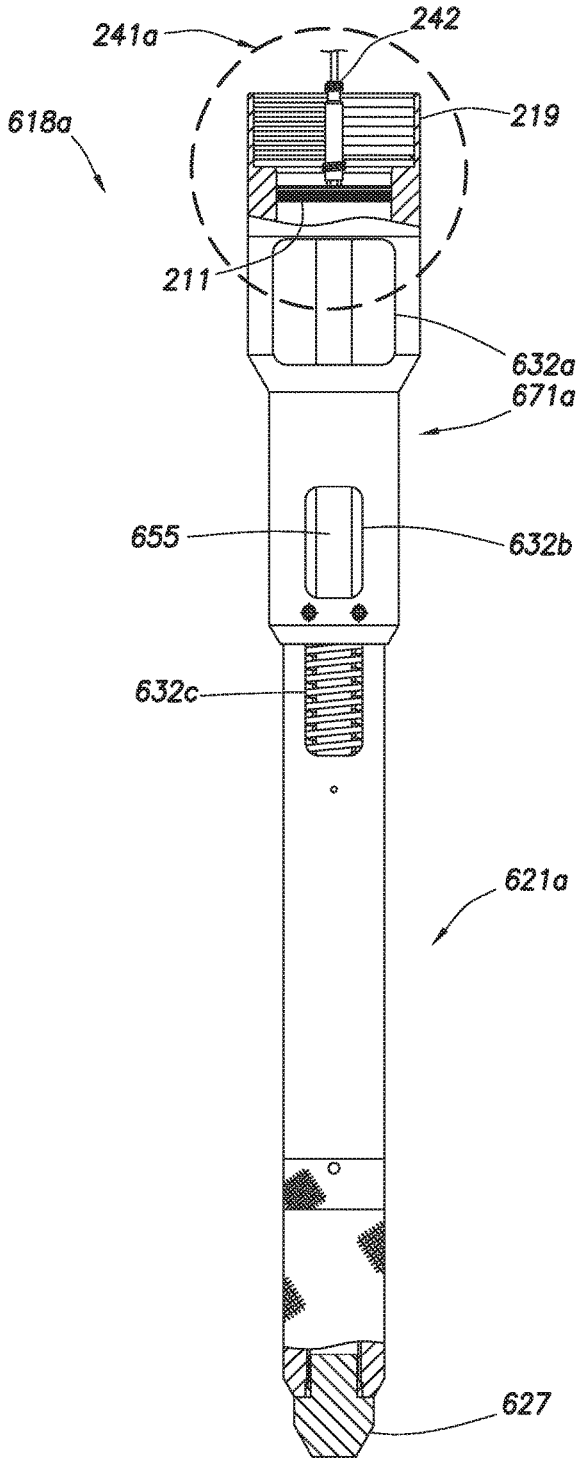
FIGS. 6A and 6B are detailed views of an uphole connector usable with the select fire bailer bottom.
Figure 6B:
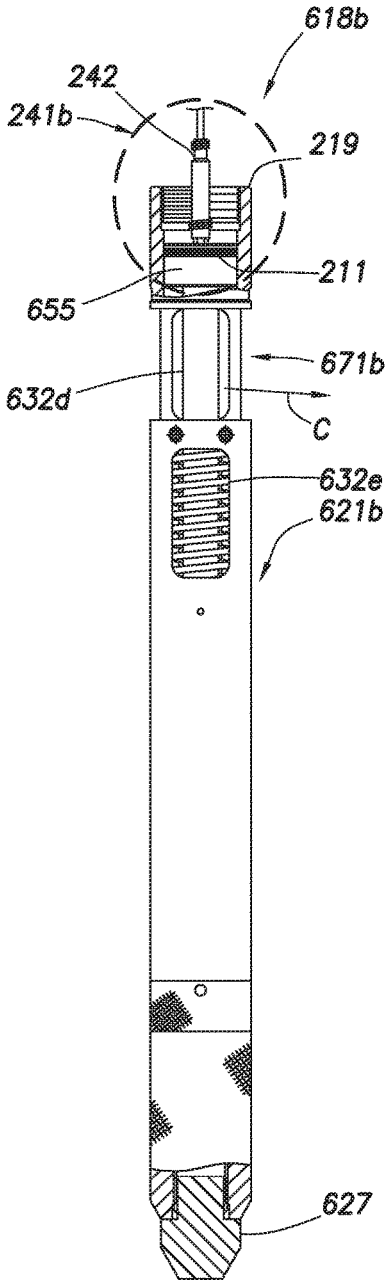

FIGS. 6A and 6B show example connections 241*a,b* shown on example bailer bottoms 618*a,b* with cement units 621*a,b* and end plugs 627 (which may be similar to the cement unit 121 and cement plug 127, respectively, of FIGS. 2A and 2B). The end plugs 627 may be removable plugs with threading of, for example, about ⅝ in (1.59 cm) diameter. The connections 241*a,b* include threaded release connections 219 threadedly connectable to an adjacent sub and a dynamic seal 211 to seal the connection. The threaded release connection 219 may have an inlet with internal threads to threadedly receive the adjacent sub, and with the connector 242 extending therethrough for electrical connection therebetween. The connector 242 extends to the dynamic seal 211. The connector 242 may be, for example, a nitrile boot with a brass connector. The connector 242 may have a hot, or power, wire extending uphole therefrom.

As shown by FIG. 6A, the threaded connection 241*a* may be coupled to the cement unit 621*a* by a sleeve 671*a*. In this version, the threaded connection 241*a* is connected to the sleeve 671*a* with a taper therebetween. The sleeve 671*a* has a receptacle therein to receivingly engage an upper end of the cement unit 621*a*. The threaded connection 241*a* has a diameter (e.g., about 2.5 in (6.35 cm) to about 3 in (7.62 cm)) greater than a diameter of the cement unit 621*a*. The threaded connection 241*a* may extend to an uphole end of the bailer bottom 618*a*. The cement unit 621*a* is also shown as having a spring loaded piston 655 extending therefrom, through the sleeve 671*a* and into the threaded connection 241*a*.

As shown by FIG. 6B, the threaded connection 241*b* may be coupled to the cement unit 621*b* by a sleeve 671*b*. In this version, the threaded connection 241*b* may be connected to the sleeve 671*b* with a step therebetween. The sleeve 671*b* has an end insertable into an upper end of the cement unit 621*b*. The threaded connection 241*b* has a diameter (e.g., about 1.75 in (4.45 cm)) about the same as a diameter of the cement unit 621*b*, with the sleeve 671*b* having a smaller diameter. The cement unit 621*b* is also shown as having a spring loaded piston 655 extending therefrom, through the sleeve 671*b* and into the threaded connection 241*b*.

The cement units 621*a,b*, sleeves 671*a,b*, and/or connections 241*a,b* may have other devices, such as a windows 632*a-e* (which may be similar to the window 232 of FIG. 2A). Multiple windows may be provided and may have, for example, a set of 3 windows at 120 degree spacing. Cement may be positioned uphole of the cement unit 621*a,b*, and selectively released by activation of the cement unit 621*a,b* to move the piston 655 to move within the sleeve 671*a,b* to allow the cement to flow out of the windows 632*a-e* as indicated by, for example, the arrow C.

Returning to FIGS. 4, 5A and 5B, the select fire unit 123 may be installed on a downhole end of the cement unit 121 upon removal of the setting unit 125 of FIGS. 2A and 2B, for example, after setting the cement plug 127 in the wellbore 114 (FIG. 1). The cement unit 121 may be coupled (directly or indirectly) to other components of the auxiliary tool 108 (e.g., wireline sub 120 of FIG. 1) via the select fire unit 123 for operation therewith.

The select fire unit 123 includes a select fire housing 230*e* comprising one or more subs connectable to the cement unit 121, including a crossover stab-in connection 570*a* and a stab-in bottom sub 570*c* with a stab-in tandem sub 570*b* therebetween. Retaining rings, O-rings, carriage seals, and other devices may also be provided.

The select fire unit 123 may include or act as the downhole switch 124*b* for selectively firing (or activating) the bailer bottom 118 and/or other components of the auxiliary tool (FIG. 1). A trigger link may be established between such components to selectively activate such components using the surface trigger 124*a* and downhole switch 124*b*.

The crossover stab-in connection 570*a* and the stab-in bottom sub 570*c* each have feed throughs 573*a,b*1 extending into passages 575*a,b*, respectively, in the stab-in tandem sub 570*b*. The passages 575*a,b* receive an end of the feed throughs 573*a,b*1 and cables 574*a*,574*c* extending therefrom. The crossover stab-in connection 570*a* includes a rubber boot sub assembly 572 and the feed through 573*a*. The connection 570*a* electrically connects to the solenoid assembly 248 via a stab-in cable 574*a*. The cable 574*ca* is also electrically coupled from the sub assembly 572 to the surface trigger 124*a* (FIG. 1).

The stab-in bottom sub (with go pin connections) 570*c* includes two feed throughs 573*b*1, *b*2, a switch sub assembly (diode package) 576, insulator connector 577, and the cables 574*b,c*. The uphole feed through 573*b*1 and cable 574*c* extend into the passage 575*b* for connection to the solenoid assembly 248 and the trigger 124*a* uphole from the select fire unit 123. Part or all of the stab-in bottom sub 570*c* and connections (or subs) 570*a-c* connected thereto may form the downhole switch 124*b* for communication with the trigger 124*a*.

The uphole feed through 573*b*1 is connectable via cable 574*c* to the solenoid assembly 248 and to the surface trigger 124*a* to receive input signals therefrom. The cable 574*b* may be connected to sub assembly (diode package) 576 to provide positive polarity, and the cable 574*a* may provide negative polarity to send select signals to one or more components in the auxiliary tool 108. The cable 574*c* may be connected to the surface trigger 124*a* to receive input signals therefrom.

The feed through 573*b*2 is connected at one end via the cable 574*b* to the switch sub assembly 576 and at another end to the insulator connector 577. The insulator connector 577 extends through a downhole end of the select fire housing 230*e* for connection to other tools. The insulator connector 577 includes a contact 578, a spring 580, an electrical contact 582, a retaining ring 584, and a connector pin 586. Various tools may be electrically connected via the insulator connector 577 to the downhole end of the select fire unit 123 for activation by the select fire unit 123.

In operation, as shown in FIG. 5A, fluid may be pumped into inlet port 268*b*, through inlet valve 266*b* and into chamber 587. The fluid then pumps through passages 267 in the tandem sub and into chamber 260, and applies pressure to piston 224 to compress spring 245*b*. The piston 224 retracts until weep holes 257 are exposed to chamber 260 to release fluid from the chamber.

Once loaded as shown in FIG. 5B, fluid may be selectively released by signaling the solenoid assembly 248 to release cement into the wellbore 114 (FIG. 1). The surface trigger 124*a* may be manually or automatically activated to signal the solenoid assembly 248 to activate the select fire unit 123. The surface trigger 124*a* signals the solenoid assembly 248 by passing a signal from the surface unit 110 via wireline 116 to cable 128 in the auxiliary tool 108 (FIG. 2B).

The cable 128 is coupled to the contact rod 246 which is coupled to the cable 574*c* which is connected to the switch sub assembly 576. Cable 574*c* connects the solenoid assembly 248 to the switch sub assembly 576 via feed through 573*b*1. The switch sub assembly 576 may have switches that change polarity based on the signal received from the surface trigger 124*a*. The switch sub assembly 576 is coupled to feed through 573*b*1 via cable 574*c* and to feed through 573*b*2 via positive cable 574*b* and to feed through 573*a* via cable 574*a*. The switch sub assembly 576 may switch between the cables 574*a,b* to selectively enable operation of the solenoid assembly 248 and another tool downhole from the select fire unit 123.

Figure 7A:
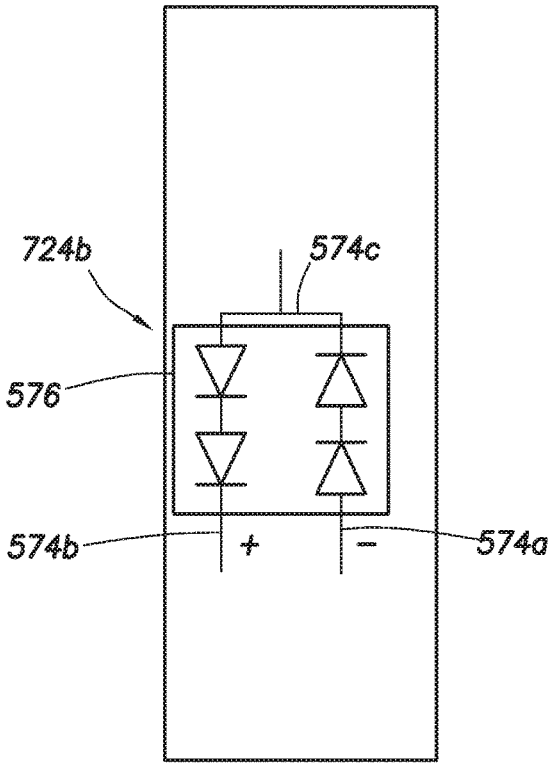
FIG. 7A is an electrical diagram of a diode trigger.
Figure 7B:
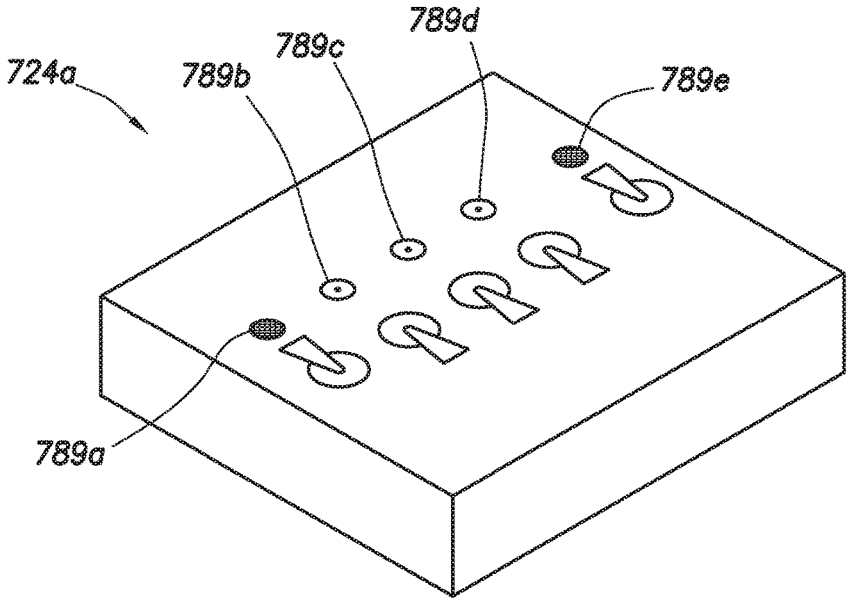
FIG. 7B is a perspective view of a switch trigger.

FIGS. 7A and 7B depict examples of the downhole switch 124*b* (and/or switch sub assembly 576) and a trigger link 124*a*, respectively. FIG. 7A is a schematic diagram of the downhole switch 124*b* in the form of a diode package (solenoid to brass contact) 724*b*. As shown by the diode package 724*b* depicted in FIG. 7A, a diode package 724*b* couples the input cable 574*c* to positive cable 574*b* and negative cable 574*a* to selectively pass signals thereto. The input cable 574*c* may be used to send a signal to the diode package 724*b* to determine if the signal is positive or negative.

If positive, the signal passed through to red (positive) wire 574*b* (not the (negative) wire 574*a*) to send current through the positive cable 574*b* (shoot through) to the next tool to activate it (e.g., setting, stroker, perforating, or other tool). If the surface trigger 124*a* and the diode package 724*b* sends a signal via the input cable 574*c* to the cable 574*b*, then a signal is sent downhole so that tools connected downhole from the select fire unit 123 may be activated.

If negative, the signal passes through the negative cable 574*a* to the solenoid assembly 248 to cause it to dump cement. If the diode package 724*b* receives a signal via the input cable 574*c* to cable 574*b*, then the solenoid assembly 248 is activated to dump cement through the exit port 268*a*.

In this manner, the select fire unit 123 may be used to selectively activate the bailer bottom 118 to perform a cement operation, or another tool in the tool string to perform another operation. This may be used to permit one or more select operations by the same tool in a single run into the wellbore.

As shown in FIG. 7B, the trigger unit 124*a* may be a digital switch control box 724*a*. In this example, the switch box 724*a* includes multiple digital switches 789*a-d* that may be used to signal the downhole switch 124*b* to selectively fire (or activate) certain components of the bailer system 100, and a power switch 789*e*.

The example switch box 724*a* is about 7.2 inches (183 mm) square by 2.75 inches (70 mm) thick, and made of heavy cast aluminum with a black crackle finish with wil (mounting) flanges on both ends. The switch box 724*a* has 120 volt ac power cord and a ultra-high frequency (UHF) connector connectable to the wireline cable (e.g., 116 of FIG. 1), and a UHF connector to go to a shooting panel. When the power switch 789*e* is off, the shooting panel may be connected directly to the wireline connection. When the power switch 789*e* is on, the panel may be ready to communicate with one or more of the downhole switches 124*b* (and/or the sub assemblies 576 of FIG. 5A).

One to four of the digital switches 789*a-d* may be provided to correspond to one or more of the downhole switches 124*b* in the tool. The digital switches 789*a-d* may be selected by toggle switch on the panel. When the downhole switches 124*b* return a signal, it tells the switch box they are on and ready to power the tools connected to them. The red light above each switch selected may light and a tone will be emitted from the box. Power may now be applied to the wireline 116 and the selected downhole switch(es) 124*b* will conduct that power to the connected tools.

The digital switches 789*a-d*, when not selected, may be a straight through connection above 25 volts positive or negative, which may look like a one ohm resistor. The switches can conduct up to 3 amperes and up to 500 volts. For example, a single switch may be a printed circuit board (PCB) switch about 3.5 inches (89 mm) long, or a four switch PCB of about 5.5 inches (140 mm) long. Both may be about 0.9 inch (23 mm) wide. The switches may conduct only positive voltage.

Figure 8A:
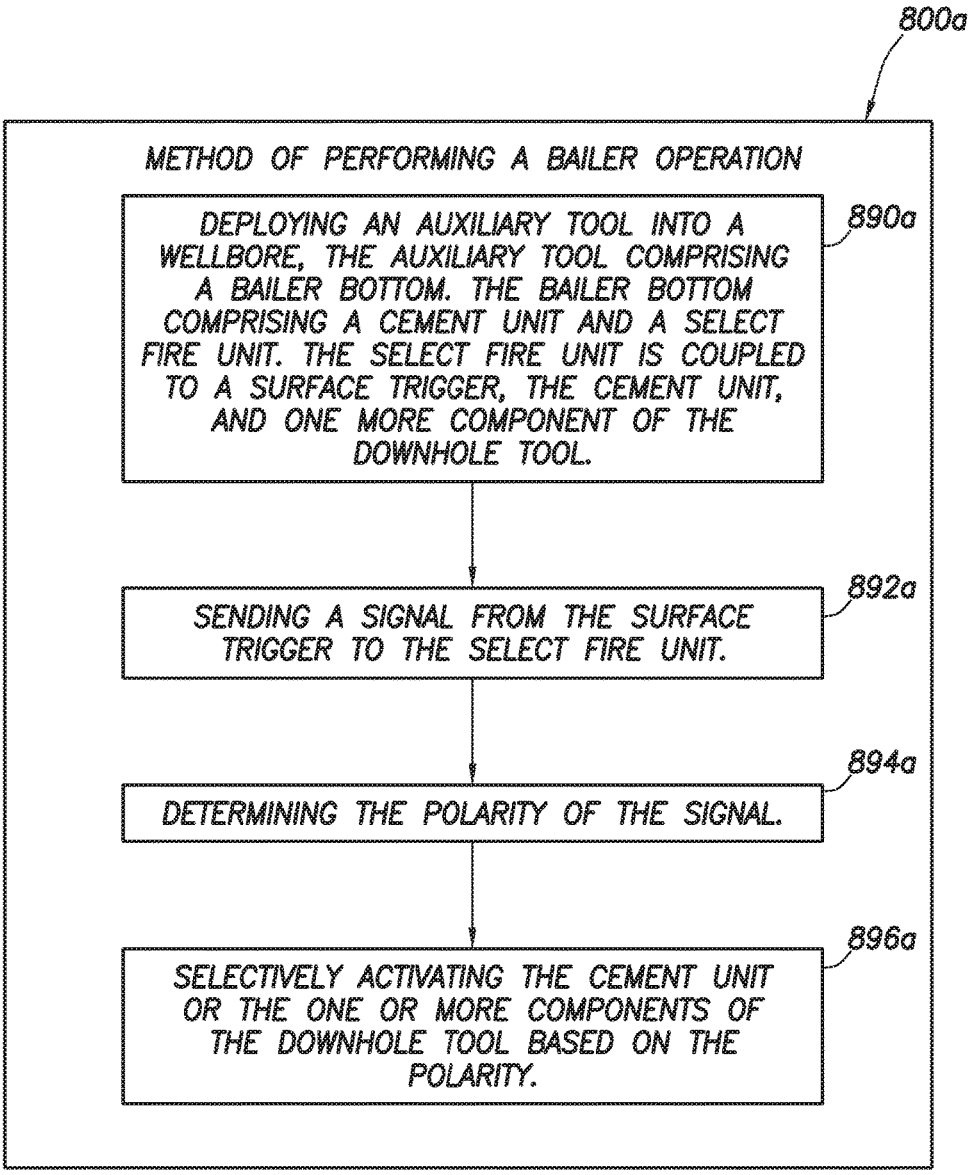
FIGS. 8A and 8B are flow charts depicting methods of performing a bailer operation.

FIG. 8A shows a method 800*a* of performing a bailer operation. The method involves 890*a*—deploying an auxiliary tool into a wellbore. The auxiliary tool comprises a bailer bottom. The bailer bottom comprising a cement unit and a select fire unit. The select fire unit is coupled to a surface trigger, the cement unit, and one or more components of the downhole tool. The method further involves 892*a*—sending a signal from the surface trigger to the select fire unit, 894*a*—determining the polarity of the signal, and 896*a*—selectively activating one of the cement unit and/or the one or more components of the downhole tool based on the polarity.

Figure 8B:
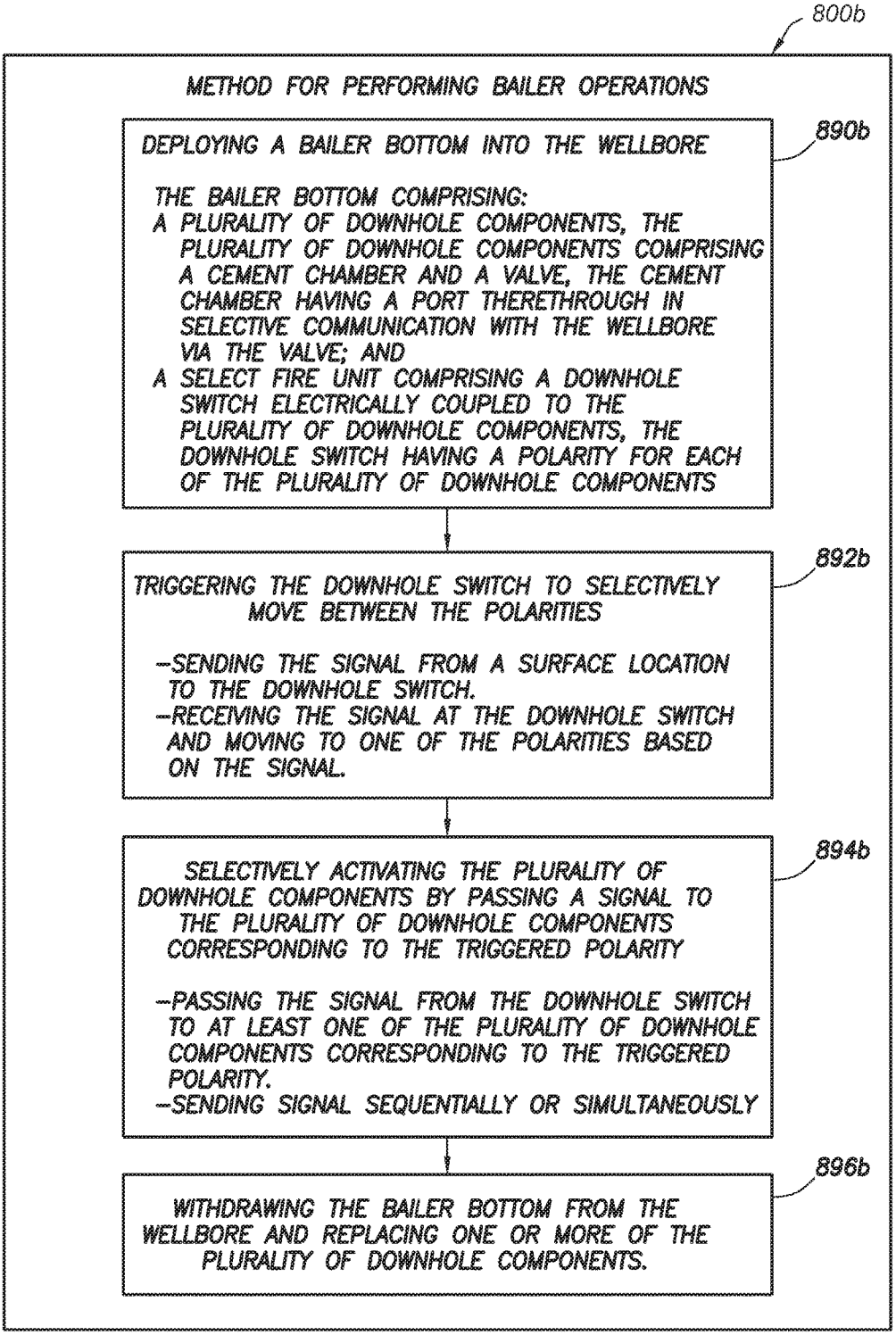

FIG. 8B shows a method 800*b* of performing a bailer operation. The method involves 890*b*—deploying a bailer bottom into the wellbore. The bailer bottom comprises a plurality of downhole components and a select fire unit. The plurality of downhole components comprises a cement unit comprising a cement chamber and a valve. The cement chamber has a port therethrough in selective communication with the wellbore via the valve. The select fire unit comprises a downhole switch electrically coupled to the plurality of downhole components. The downhole switch has multiple polarities comprising a polarity for each of the plurality of downhole components.

The method further involves 892*b*—triggering the downhole switch to selectively move between the multiple polarities. This may involve sending a signal from a surface location to the downhole switch and/or receiving the signal at the downhole switch and moving to one of the polarities based on the signal. The method further involves 894*b*—selectively activating the plurality of downhole components by passing an activation signal to the plurality of downhole components corresponding to the triggered polarity. This may involve passing the signal from the downhole switch to at least one of the plurality of downhole components corresponding to the triggered polarity and/or sending the signal sequentially or simultaneously. The method continues with 896*b*—withdrawing the bailer bottom from the wellbore and replacing one or more of the plurality of downhole components.

Part or all of the method may be performed in any order, and repeated as desired.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application claims the benefit of priority from this application.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A bailer bottom for performing bailer operations at a wellsite, the wellsite positioned about a wellbore penetrating a subterranean formation, the bailer bottom deployable into the wellbore, the bailer bottom comprising:

a plurality of downhole components, the plurality of downhole components comprising a cement unit, the cement unit comprising a cement chamber and a valve, the cement chamber having a port therethrough in selective communication with the wellbore via the valve;

a select fire unit comprising a downhole switch electrically coupled to the valve and to the plurality of downhole components, the downhole switch having a trigger signal for the valve and for each of the plurality of downhole components, the downhole switch triggerable to selectively move between the trigger signal for each of the plurality of downhole components and to selectively pass an activation signal to the valve or to one of the plurality of downhole components whereby the plurality of downhole components are selectively activated;

wherein the cement unit further comprises a piston slidably positionable in the cement chamber between an extended position and a retracted position, a volume of the cement chamber reduced as the piston moves from the retracted to the extended position; and wherein the piston is electrically coupled between a surface trigger and the valve.

2. The bailer bottom of claim 1, wherein the cement unit further comprises at least one spring positioned about the piston, the at least one spring biased to urge the piston to the extended position.

3. The bailer bottom of claim 1, wherein the cement unit further comprises an electrical contact rod electrically coupled between the piston and the valve, an end of the electrical contact rod extending into a cavity in the piston for slidable movement therebetween.

4. The bailer bottom of claim 1, wherein the cement unit further comprises a threaded connector at an end thereof having an inlet to mechanically receive another of the plurality of downhole components and an electrical connector to electrically connect with the another of the plurality of downhole components.

5. The bailer bottom of claim 4, further comprising a windowed sleeve connectable between the threaded connector and the cement unit.

6. The bailer bottom of claim 1, wherein the valve comprises a solenoid movable between an open and a closed position.

7. The bailer bottom of claim 1, wherein the downhole switch comprises a diode package.

8. The bailer bottom of claim 1, wherein the select fire unit comprises a crossover stab-in connection connectable to the cement unit, a stab-in bottom sub, and a stab-in tandem sub between the crossover stab-in connection and the stab-in bottom sub.

9. The bailer bottom of claim 8, wherein the select fire unit further comprises feed-throughs, each of the feed-throughs positioned in one of the crossover stab-in connection, the stab-in bottom sub, and the stab-in tandem sub.

10. The bailer bottom of claim 9, wherein each of the feed-throughs is electrically coupled between the downhole switch and one of the valve, a surface trigger, and at least one of the plurality of downhole components.

11. The bailer bottom of claim 1, wherein the downhole switch comprises electrical connectors, each of the trigger signals electrically coupled to the plurality of downhole components via the electrical connectors.

12. The bailer bottom of claim 1, wherein the plurality of downhole components comprises at least one selected from the group of: plugs, packers, valves, injectors, perforating guns, hangers, cement plug dripping heads, setting tools, bailing tools, sampling tools, testing tools, measuring tools, communication tools, a bailer window sub, bailer joints, and combinations thereof.

13. A bailer system for performing bailer operations at a wellsite, the wellsite positioned about a wellbore penetrating a subterranean formation, the bailer system comprising:

a bailer bottom comprising:

a plurality of downhole components, the plurality of downhole components comprising a cement unit, the cement unit comprising a cement chamber and a valve, the cement chamber having a port therethrough in selective communication with the wellbore via the valve; and a select fire unit comprising a downhole switch electrically coupled to the valve and to the plurality of downhole components, the downhole switch having a trigger signal for the valve and for each of the plurality of downhole components, the downhole switch triggerable to selectively move between the trigger signal for each of the plurality of downhole and to selectively pass an activation signal to the valve or to one of the plurality of downhole components whereby the plurality of downhole components are selectively activated; and at least one trigger electrically coupled to the downhole switch to send the activation signal thereto whereby the plurality of downhole components are selectively activated;

wherein the at least one trigger comprises a digital switch control box; and wherein the digital switch control box comprises a power switch and at least one digital switch, each of the at least one digital switches corresponding to one of the cement unit and another of the plurality of downhole components.

14. The bailer system of claim 13, wherein the at least one trigger comprises at least one of a surface trigger and a downhole trigger.

15. The bailer system of claim 13, wherein the bailer bottom is deployed into the wellbore by a cable.

16. A bailer bottom for performing bailer operations at a wellsite, the wellsite positioned about a wellbore penetrating a subterranean formation, the bailer bottom deployable into the wellbore, the bailer bottom comprising:

a plurality of downhole components, the plurality of downhole components comprising a cement unit, the cement unit comprising a cement chamber and a valve, the cement chamber having a port therethrough in selective communication with the wellbore via the valve; and a select fire unit comprising a downhole switch electrically coupled to the plurality of downhole components, the downhole switch having a trigger signal for each of the plurality of downhole components, the downhole switch triggerable to selectively move between the trigger signal for each of the plurality of downhole components and selectively pass an activation signal to one of the plurality of downhole components whereby the plurality of downhole components are selectively activated;

wherein the cement unit further comprises a piston slidably positionable in the cement chamber between an extended position and a retracted position, a volume of the cement chamber reduced as the piston moves from the retracted to the extended position; and wherein the piston is electrically coupled between a surface trigger and the valve.

17. The bailer bottom of claim 16, wherein the cement unit further comprises an electrical contact rod electrically coupled between the piston and the valve, an end of the electrical contact rod extending into a cavity in the piston for slidable movement therebetween.

18. The bailer bottom of claim 16, wherein the cement unit further comprises a threaded connector at an end thereof having an inlet to mechanically receive another of the plurality of downhole components and an electrical connector to electrically connect with the another of the plurality of downhole components.

19. The bailer bottom of claim 18, further comprising a windowed sleeve connectable between the threaded connector and the cement unit.

20. A bailer system for performing bailer operations at a wellsite, the wellsite positioned about a wellbore penetrating a subterranean formation, the bailer system comprising:

a bailer bottom comprising:

a plurality of downhole components, the plurality of downhole components comprising a cement unit, the cement unit comprising a cement chamber and a valve, the cement chamber having a port therethrough in selective communication with the wellbore via the valve; and a select fire unit comprising a downhole switch electrically coupled to the plurality of downhole components, the downhole switch having a trigger signal for each of the plurality of downhole components, the downhole switch triggerable to selectively move between the trigger signals and selectively pass a signal to one of the plurality of downhole components whereby the plurality of downhole components are selectively activated; and at least one trigger electrically coupled to the downhole switch to send the signal thereto whereby the plurality of downhole components are selectively activated;

wherein the at least one trigger comprises a digital switch control box; and wherein the digital switch control box comprises a power switch and at least one digital switch, each of the at least one digital switches corresponding to one of the cement unit and another of the plurality of downhole components.

* * * * *